US005907137A

United States Patent [19]

Tyni et al.

[11] Patent Number: 5,907,137

[45] Date of Patent: May 25, 1999

[54] GENETIC PROCEDURE FOR ALLOCATING LANDING CALLS IN AN ELEVATOR GROUP

[75] Inventors: Tapio Tyni; Jari Ylinen, both of Hyvinkää , Finland

[73] Assignee: Kone Corporation, Helsinki, Finland

[21] Appl. No.: 09/134,370

[22] Filed: Aug. 14, 1998

[30] Foreign Application Priority Data

Aug. 15, 1997 [FI] Finland ..... 973346

[51] Int. Cl.[6] ..... B66B 1/18

[52] U.S. Cl. ..... 187/382; 187/380; 187/910; 187/13

[58] Field of Search ..... 187/388, 382, 187/247; 706/13, 910

[56] References Cited

U.S. PATENT DOCUMENTS 5,780,789 7/1998 Tsuji ..... 187/382
5,848,403 12/1998 Gabriner et al. ..... 706/13

FOREIGN PATENT DOCUMENTS 5-319707 12/1993 Japan .
8-245091 9/1996 Japan .
2288675 10/1995 United Kingdom .

OTHER PUBLICATIONS

Lawrence Davis, Handbook of Genetic Algorithms, pp. 1–560, 90–99, 333–349, 1991.

*Primary Examiner*—Robert E. Nappi

[57] ABSTRACT

Genetic procedure for the allocation of calls for elevators comprised in an elevator group. In the procedure, a plurality of allocation options, i.e. chromosomes (33) are formed, each of which contains a call data item and an elevator data item for each landing call, and these data, i.e. genes together define an elevator to serve the landing call. A fitness function value (34) is determined for each chromosome (33) and one or more of the chromosomes (33) are modified and, based on the fitness function values, the best chromosome (33) is selected and the elevator group is controlled in accordance with this chromosome. According to the invention, the chromosomes (33) and the corresponding fitness function values (34) are collected in a file, i.e. a gene bank, and each chromosome (33) generated is compared with the chromosomes (33) in the gene bank, and a fitness function value (34) is only determined for a new chromosome (33).

18 Claims, 4 Drawing Sheets

GENETIC PROCEDURE FOR ALLOCATING LANDING CALLS IN AN ELEVATOR GROUP

Figure 1:
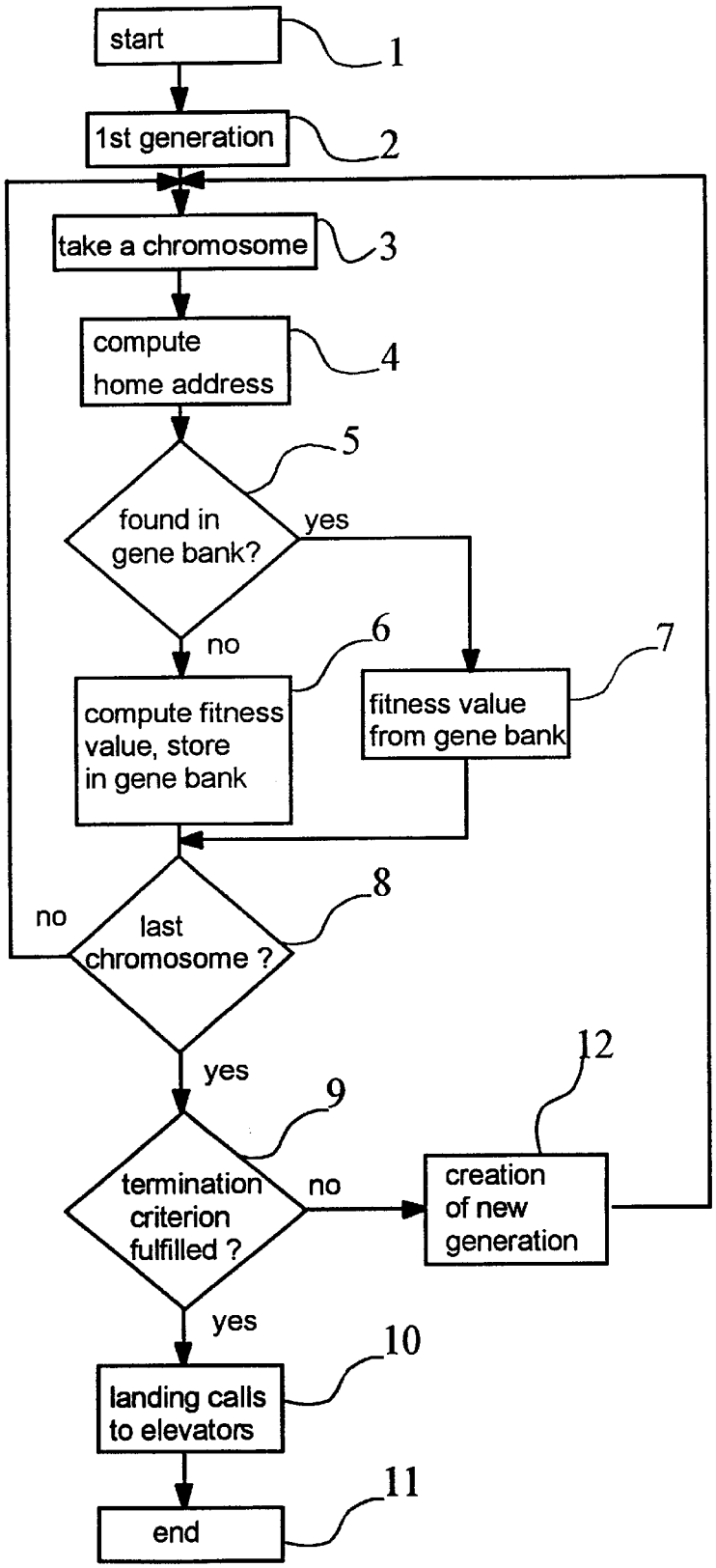

The present, invention relates to a genetic procedure for allocating calls entered via landing call devices of elevators comprised in an elevator group.

When a passenger wants to have a ride in an elevator, he/she calls an elevator by pressing a landing call button mounted on the floor in question. The elevator control system receives the call and tries to determine which one of the elevators in the bank will be best to serve the call. The activity involved here is referred to as call allocation. The problem to be solved by allocation is to find out which one of the elevators will minimise a preselected cost function.

Conventionally, to establish which one of the elevators will be suited to serve a call, the reasoning is performed individually in each case by using complex condition structures. Since the elevator group has a complex variety of possible states, the condition structures will also be complex and they often have gaps left in them. This leads to situations in which the control does not function in the best possible way. Furthermore, it is difficult to take the entire elevator group into account as a whole.

Finnish patent application FI 951925 presents a procedure for the allocation of landing calls in an elevator group, in which some of the problems described above have been eliminated. This procedure is based on forming a number of allocation options, each of which comprises a call data item and an elevator data item for each active landing call, and these data together define the elevator to serve each landing call. After this, the value of a cost function is computed for each allocation option and one or more of the allocation options are repeatedly changed with respect to at least one of the data items comprised in it, whereupon the values of the cost functions of the new allocation options thus obtained are computed. Based on the values of the cost functions, the best allocation option is selected and the active elevator calls are allocated accordingly to the elevators in the elevator group.

The solution presented in the above application substantially reduces the required calculation work as compared with having to calculate all possible route alternatives. In this procedure, which is based on a genetic algorithm, the elevator group is treated as a whole, so the cost function is optimised at the group level. The optimisation process need not be concerned with individual situations and ways of coping with them. By modifying the cost function, desired operation can be achieved. It is possible to optimise e.g. passenger waiting time, call time, number of starts, travelling time, energy consumption, rope wear, operation of an individual elevator if using a given elevator is expensive, uniform use of the elevators, etc., or a desired combination of these.

The solution according to the above application substantially reduces the required calculation work as compared with having to calculate all possible allocation options and their respective fitness values. Depending on the problem, determining a fitness value for a given allocation option may take anything from a few fractions of a second to several seconds. This means that because the genetic algorithms operate with a number of alternative solutions that are developed further until a terminating criterion is met, the time spent in solving the problem may be considerable.

However, the procedure described above has certain drawbacks. Call allocation has to be carried out within a length of time that is so short that the person issuing the call practically does not become aware of it. Thus, the tasks of forming the allocation options, calculating the corresponding fitness function values and selecting the optimal result, which together may be a relatively demanding operation, have to be carried out e.g. in less than half a second The object of the present invention is to eliminate the drawbacks mentioned above. A specific object of the invention is to present a new type of genetic procedure that is substantially faster and more accurate than prior-art procedures, allowing e.g. real-time corrections even with the computing capacity of currently available processors.

As for the features characteristic of the invention, reference is made to the claims.

The genetic procedure of the invention is based on the insight that it is not necessary to compute a fitness function value for each alternative solution but, especially at the final stage of the procedure, mainly solution alternatives for which a fitness function value has been defined before are formed, and this definition can be utilised to avoid complex and time-consuming computation of fitness function values.

In the genetic procedure of the invention, a plurality of allocation options or chromosomes are formed, each of which contains a call data item and an elevator data item for each active landing call, and these data, i.e. genes together define an elevator to serve each landing call. For each chromosome thus formed, a fitness function value is determined. After this, one or more of the chromosomes are mutated in respect of at least one gene and fitness function values are determined for the new chromosomes obtained. The search, i.e. the process of forming new chromosomes, is continued until a predetermined termination criterion is met, whereupon the best chromosome is selected on the basis of the fitness function values and the calls are allocated to the elevators in the elevator group in accordance with this solution. According to the invention, the chromosomes and the corresponding fitness function values are collected in a file, a so-called gene bank. Each chromosome formed is compared with the chromosomes in the gene bank, and a fitness function value is only determined for a new chromosome that is not found in the gene bank. After this, the new chromosome and the corresponding fitness function value are added into the gene bank. Thus, according to the invention, a fitness function value is computed only once for each new chromosome created in the procedure, and always when a chromosome is formed that has appeared in the procedure before, the corresponding fitness function value is obtained from the gene bank without computational and time-consuming operations.

In the procedure of the invention, a set of allocation options, i.e. chromosomes, constitutes a generation, of which generally the best ones are selected for reproduction to form a new generation of chromosomes. The new generation is formed from the selected chromosomes using a genetic algorithm, via selection, crossbreeding and/or mutation.

The procedure of the invention can be continued until the desired target has been reached, e.g. until reaching a certain fitness function value, or until a given number of new generations have been created, or the procedure can be interrupted after a given length of processing time. Another circumstance that can be regarded as a terminating criterion is sufficient homogeneity of the population.

As it is possible that very large amounts of data, i.e. chromosomes and corresponding fitness function values, are accumulated in the gene bank with time as the procedure is applied, the gene bank is preferably implemented using a range of addresses, each chromosome to be stored in the gene bank being assigned a home address defining the location of the chromosome in the gene bank. The home address of a chromosome is preferably determined from one or more of its genes, preferably using a so-called randomising function. The genes or gene sequences thus function as keys to the gene bank and to certain home addresses in it. An ideal randomising function can be quickly computed and gives values that are equally probable for each home address in the gene bank. In practice, however, the distribution of the home addresses computed from the genes of the chromosomes is not known beforehand, and consequently the numbers of different chromosomes at the same home address may vary. The definition of the home address may be based e.g. on the content of the genes in the chromosome, the number of genes, width of the gene bank or other corresponding simple numeric values, from which the home address can be determined by appropriate calculations or other operations.

For example, from the genes or gene sequences of the chromosomes, a gene bank home address can be computed for each chromosome, and the desired data associated with the chromosomes are stored at this address, which allows fast location of the data. Each chromosome may contain one or more genes, and in principle each gene may consist of one or more bits. Thus, depending on the interpretation, the genes may be e.g. binary or integer numbers.

The home address for a given chromosome can be defined e.g. by first computing the sum of the values of its individual genes, whereupon the final home address can be computed by taking the remainder of the calculated value. In other words, the value computed from the genes of the chromosome is divided by the width of the gene bank, thus obtaining a remainder whose value is in the range 0—(gene bank width—1), and this value is given as the home address of the chromosome to the gene bank.

Chromosomes having the same home address can be linked to form chains of unlimited length, in which case the maximum depth of the gene bank is unlimited. On the other hand, the chain formed by chromosomes having the same home address can be implemented as fixed table of a given length, so if the table is full when a new chromosome is to be stored in it, one of the chromosomes is removed from the table. When the table becomes full, the chromosome to be removed is preferably the last one in the table, but other criteria can also be used. For instance, it is possible to remove the oldest chromosome in the table or the chromosome having the lowest fitness function value.

In the procedure of the invention, with the passing of generations, searching is typically increasingly focused on a certain area of the address range to be searched. Therefore, the chromosomes that appeared at the beginning of a search for a solution will begin to change, and at the same time the genetic algorithm will start generating chromosomes that may differ considerably from the chromosomes encountered at the beginning. When new chromosomes are stored in the gene bank, this circumstance can be utilised by storing the new chromosome in the first position in the chain starting from the home address. In this way, the older chromosomes will automatically move farther and farther away from the beginning of the chain. As it is more probable that new chromosomes bear a closer resemblance to the younger chromosomes at the home addresses in the gene bank than to the older chromosomes, chromosomes already encountered and generated again can be quickly located right at the beginning of the home address range in the gene bank.

In the technique used to store the chromosomes to the gene bank, it is also possible to use an adaptable gene bank structure. When certain chromosomes appear clearly more frequently than others during a search, it will be advantageous to have these chromosomes placed at or near the beginning of the chains to allow a faster search. When a chromosome is searched for and found in a chain, if is preferably moved closer to the beginning of the chain at the same time. Thus, a chromosome found at a given home address can be moved to the first place in the chain or it can be moved by a given amount, e.g. by a few positions towards the beginning of the chain.

The gene bank can also be constructed using a ring-like list structure consisting of elements interlinked in two directions. In this case, a reference is provided from the home address corresponding to this ring to one of the elements. Each element contains a place for a gene data item, a fitness data item and a valid-data item, i.e. a status data item indicating whether the element contains data or whether it is void.

The ring-like list structure is read e.g. in the clockwise direction until the desired genes are encountered. If the gene data searched for is not found on the list, reading is terminated when the beginning of the list is reached again after a full circle. If the list is not full, reading is only continued until the valid-data indicates a void element, signifying that the end of data has been reached.

If the list is read in the clockwise direction, then the data are written to the ring-like list structure in the anti-clockwise direction, and the home address reference is changed so that it points to a new element written, from which the next writing or reading operation is to begin.

The data stored in the gene bank preferably also comprises additional information about the chromosome, such as e.g. generation or current number.

The procedure of the invention has significant advantages as compared with prior art. The procedure allows substantially faster action of the genetic algorithm especially when the target function of the problem being solved is a complex one and requires plenty of computing capacity. In addition to accelerating the optimisation, another advantage is that the genetic algorithm provides a better solution if a certain fixed time given in advance is used. The time saved via faster optimisation can also be spent on a more careful analysis of the search range, which leads to an increased certainty that the solution is a good one and to a probability that the solution is also of a better quality.

Although the procedure of the invention has been described in the foregoing as applied to the control of an elevator group, it is a general-purpose procedure for faster and more effective genetic computation and optimisation. It can also be used for genetic parallel computation and in a decentralised computation environment. The more effective processing by the procedure of the invention is significant especially in real time control (when the aim is to solve the problem in real time) and in the case of problems requiring particularly heavy computation and/or simulation.

Figure 2:
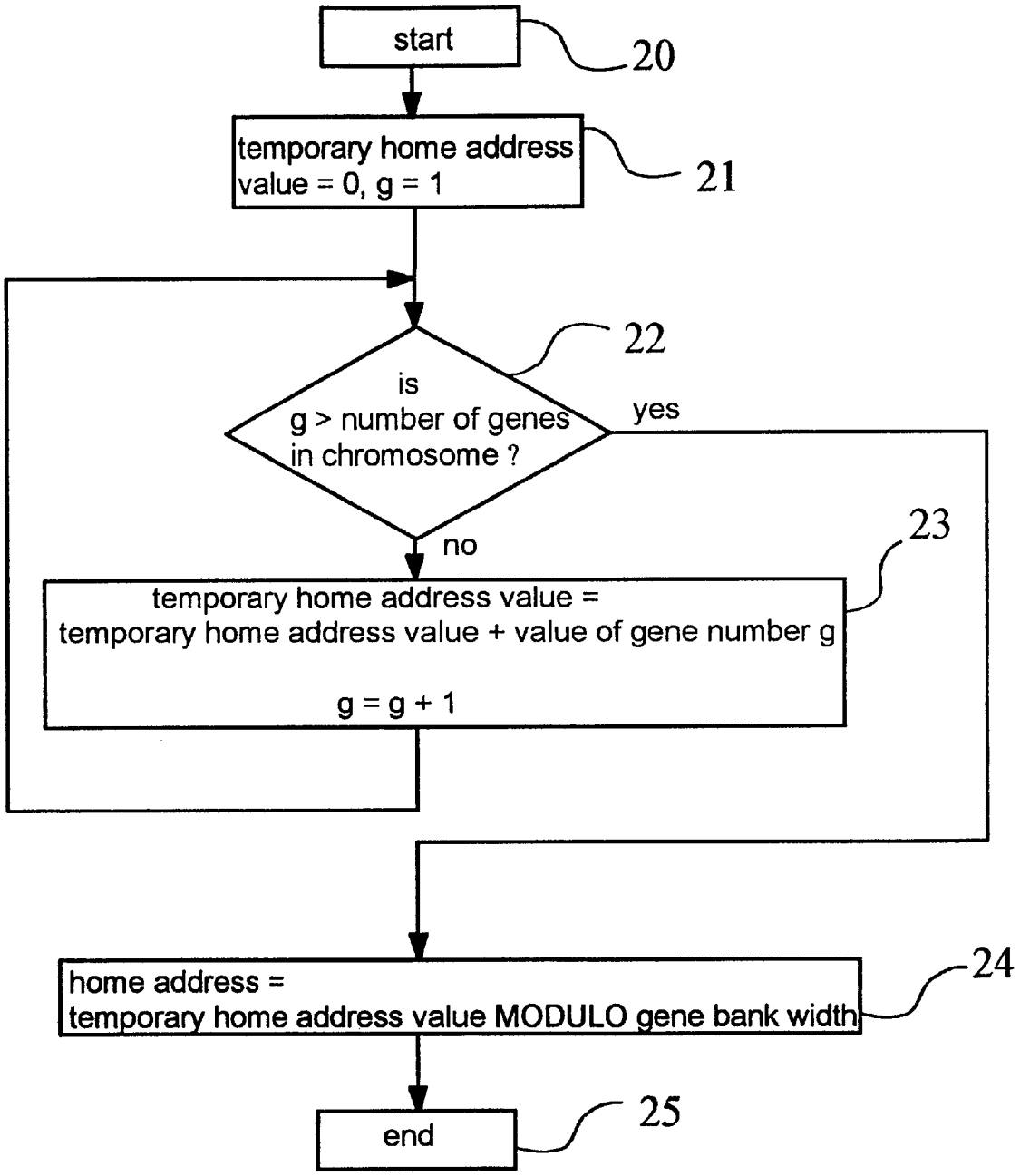
Figure 3:
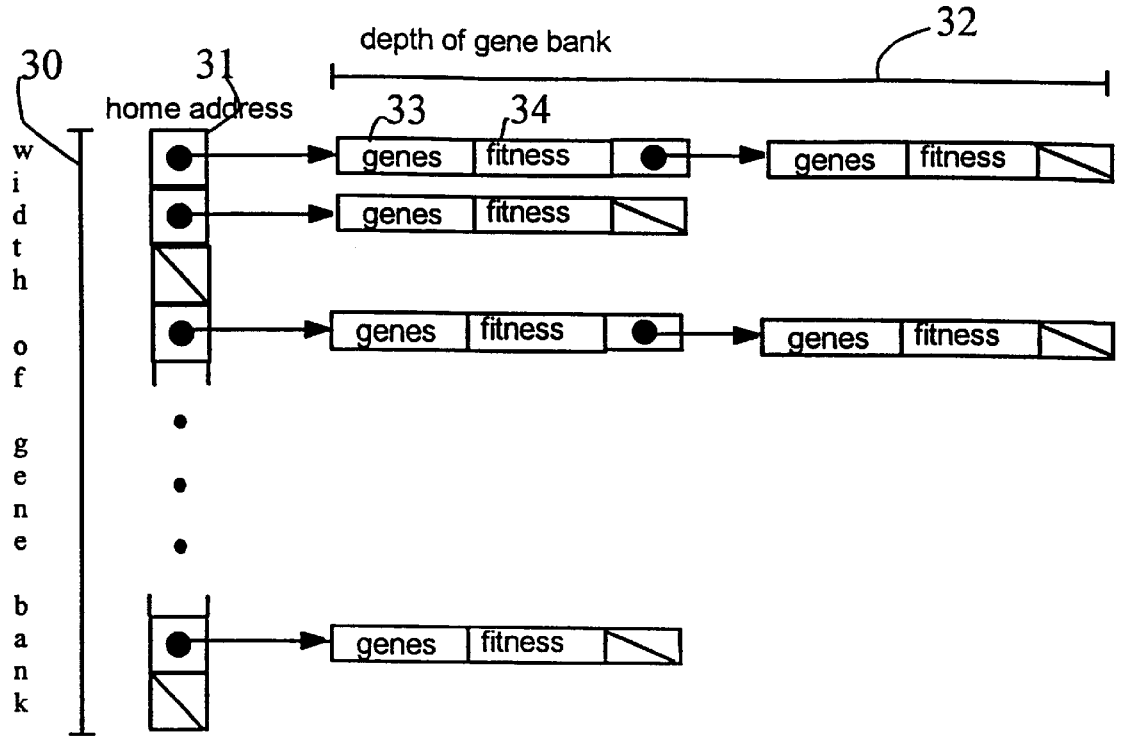
Figure 4:
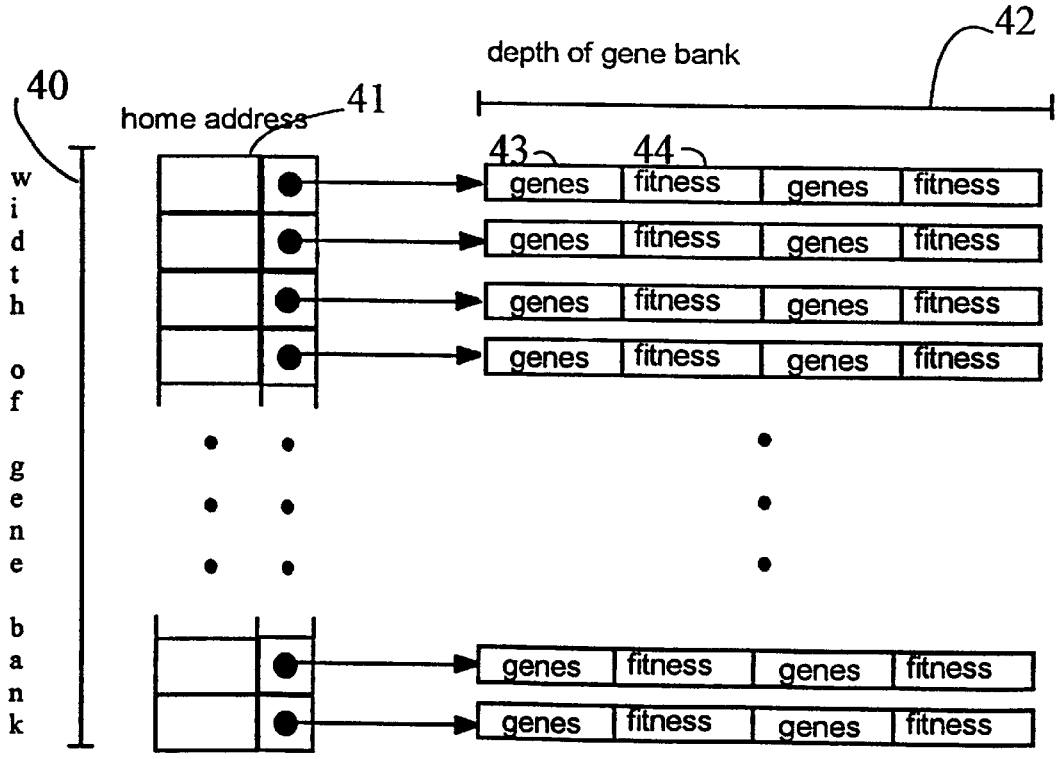
Figure 5:
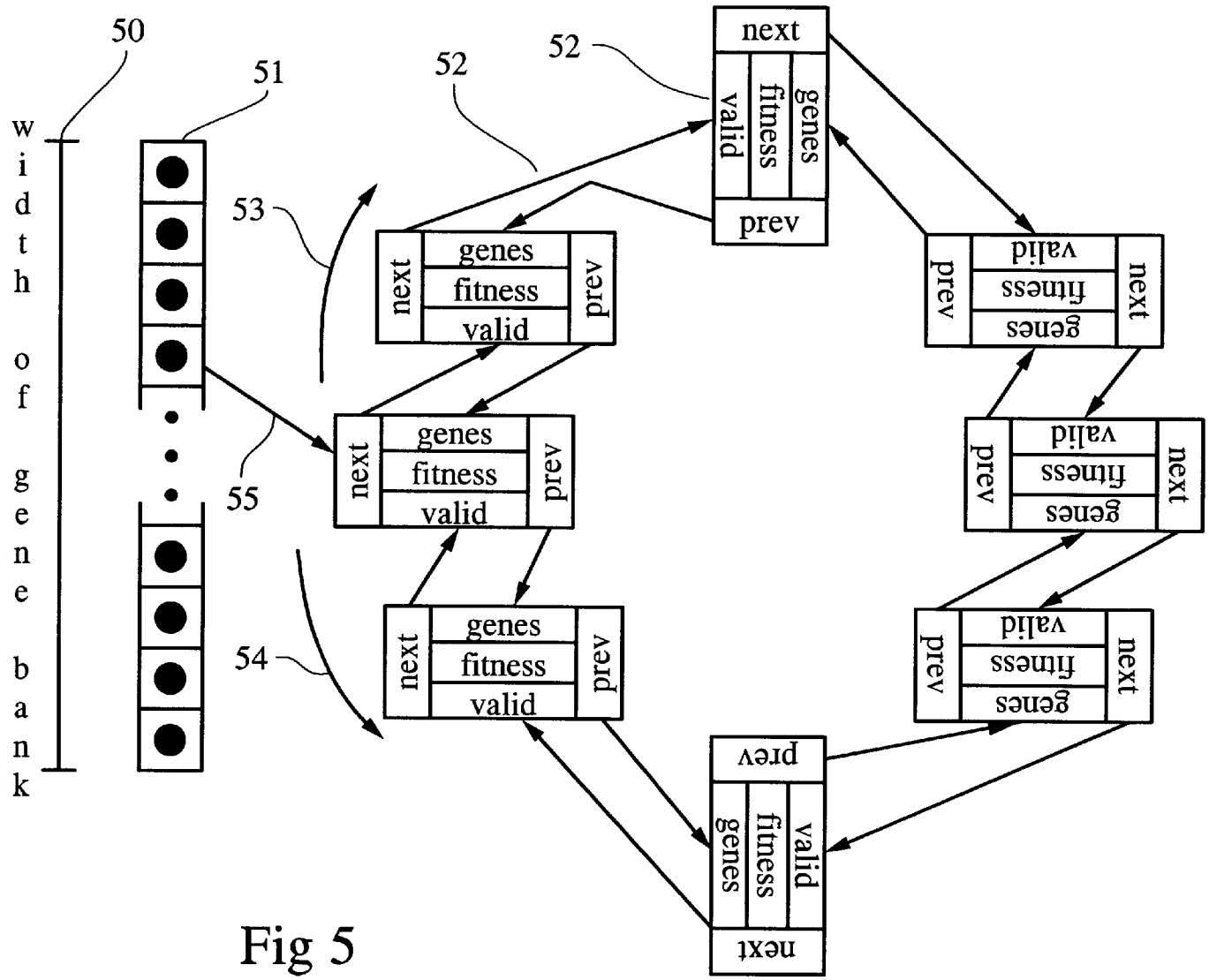

In the following, the invention will be described in detail by referring to the attached drawings, in which FIG. 1 presents a block diagram representing the procedure of the invention, FIG. 2 presents a block diagram for the definition of the home address, FIG. 3 illustrates a gene bank structure, FIG. 4 illustrates another gene bank structure, and FIG. 5 illustrates a third gene bank structure.

FIG. 1 presents the various stages of the procedure of the invention. The elevator control system starts call allocation, starting block 1, when at least one landing call is to be allocated to an elevator. The length of the elevator chromosome is determined by factors like the number of landing calls active at the time and the number of elevators available. In block 2, a first generation of allocation options or chromosomes is generated on the basis of the initial data, e.g. by a stochastic process. The first generation of chromosomes can be created e.g. by a stochastic process, partly based on an earlier allocation result or by using direct collective control as a starting point.

After this, the chromosomes of this generation are examined one by one, so in block 3 one of the chromosomes of the generation is taken. In block 4, a home address is formed for the chromosome. FIG. 2 shows a block diagram illustrating the manner of defining the home address as will be explained in more detail later on. In block 5, the procedure finds out whether a corresponding chromosome exists already in the gene bank. If no such chromosome is found, then the chromosome is a new one and a fitness value is computed for it in block 6 and the data are stored in the gene bank.

If the chromosome is found in the gene bank, then its fitness value is retrieved from the gene bank in block 7 and this fitness value is assigned to the chromosome. Moreover, when the chromosome is found in the gene bank, only the data in the gene bank can be rearranged for the chromosome in question.

If not all of the chromosomes of the generation have been examined yet, the procedure returns from block 8 to block 3, where the next chromosome is taken up for inspection. After the entire generation has been examined, the procedure goes on from block 8 to block 9, where a test is carried out to determine whether the termination criterion has been fulfilled.

In block 9, an estimation is carried out, based e.g. on the fitness values, the process time consumed or the number of processing cycles performed, to decide whether the procedure should be carried on or whether the best values obtained last should be accepted. When the criteria for terminating the allocation process are fulfilled, the procedure goes on to block 10 and the landing calls are allocated to the elevators in accordance with the best chromosome, whereupon control is passed to the elevator control system via the termination block 11.

If the termination criteria were not yet fulfilled in block 9, the procedure goes on to block 12, where, based on the fitness function values, the best or otherwise most viable or interesting chromosome/chromosomes is/are selected and stored at least for the next generation. From the chromosomes thus selected, a new chromosome generation is created according to the genetic algorithm: suitable chromosomes are selected for further optimisation, a new chromosome is created from two older chromosomes by selecting some of the genes of each and/or the genes of an older chromosome are altered in some respects via random mutation. It is possible e.g. to change the value of a gene with a given probability within the limits of a given range of values.

The new chromosome generation obtained is tested in block 3 one chromosome at a time, and this process is continued from generation to generation until the termination criterion is fulfilled.

As can be seen from the attached block diagram, the gene bank significantly reduces the number of computation cycles needed to determine the fitness function values. The actual time saved is not quite directly proportional to the number of computation cycles. The time consumed by the gene bank operations must also be considered. The gene bank will only become productive when the time taken by the gene bank processing is shorter than the time saved by avoiding the computation of fitness function values. Therefore, with very simple fitness functions the gene bank will provide no advantage in respect of computation speed. Use of the gene bank in the genetic algorithm is worth considering if the average gene bank processing time, which consists of the search and writing operations and possible dynamic memory allocation, is shorter than the time required for the computation of a single fitness function value. The processing operations are fast and they can be carried out effectively.

The home address in block 4 can be calculated e.g. in accordance with the block diagram in FIG. 2. The principle in this example is that the values of individual genes of the chromosome under examination are first added together, whereupon a final home address can be calculated for it by taking the remainder from the value thus obtained. The value of the gene e.g. in an elevator application may be the number of the elevator to serve the landing call. In other words, the value calculated from the genes of the chromosome is divided by the width of the gene bank, so the remainder will be a value in the range 0—(gene bank width—1), and this value is given to the gene bank as the home address of the chromosome. When the procedure reaches the home address computation phase, it proceeds via the starting block 20 to block 21, where a temporary home address starting value is set to 0 and a variable g is set to 1. In block 22, a test is carried out to determine whether variable g is larger than the number of genes in the chromosome being examined. In a negative case, a new temporary home address value is calculated by adding the value of gene number g to the temporary home address value and g is increased by one in block 23 and action is resumed from block 22. In a positive case, the procedure goes on from block 22 to block 24, where the home address is set to the value of temporary home address value MODULO gene bank width.

FIG. 3 presents a gene bank structure in which the gene bank width 30 is determined by the number of home addresses 31 while the depth 32 of the gene bank is unlimited. Thus, at each home address it is possible to store an unlimited number of chromosomes 33 and corresponding calculated fitness function values 34 as a linked chain starting from the home address. Therefore, each home address 31 may contain zero or more chromosomes, whose location in the gene bank, i.e. home address, can be calculated from one or more of the genes of the chromosome using a suitable randomising function. A new chromosome and the corresponding fitness value are always stored in the first position in the chain, so the chromosomes already in the chain are moved farther.

FIG. 4 presents a gene bank application in which the gene bank width 40 is determined by the number of home addresses 41 and the depth 42 of the gene bank is limited.

In this case, at each home address 41 separately, it is only possible to store a certain amount of data, i.e. a certain number of chromosomes 43 and corresponding fitness function values 44. When a new chromosome and its fitness value are stored in the first position in the table at a give home address, the last one at the end of the table is dropped off if the table is full. This chromosome and the corresponding fitness value removed from the table are the oldest data at the home address in question and very probably this is the one of the chromosomes in the table that bears the least relation to the desired final result of the procedure. Therefore, removing this data will not impair the achievement of an optimal result in the procedure. As the depth of the home address is limited, it can be quickly examined during a search to find a chromosome corresponding to a new chromosome created. Moreover, there is a high probability that the new chromosome created can be found even at a relatively short home address because new chromosomes bear a closer resemblance to the younger chromosomes in the gene bank and chains than to the older ones.

FIG. 5 presents a third gene bank application, in which the gene bank width is determined by the number of home addresses 51. From each home address in the randomising table there is a reference to a list structure consisting of elements 52 interlinked in two directions and arranged in a ring. The number of elements in the ring determines the depth of the gene bank.

Each element 52 has a place for gene data, fitness data and valid-data, i.e. status data indicating whether the element is void or whether it contains gene data. The linked list is read in the clockwise direction 53 until the desired genes are encountered or until the beginning of the list is reached again after a full circle. Especially in the early stages of the procedure, the list is often only partially full, so to accelerate the processing it is not reasonable to search through the entire list each time. For this reason, the elements comprise a valid-data item, so the search of the list can be terminated upon encountering the first valid-data item indicating a void element.

Data is written to the linked ring in the direction opposite to the reading direction 53, i.e. counter-clockwise 54. To do so, the element preceding the home address reference 55 is selected and the genes and the fitness value as well as the valid-data are written to it. In addition, the home address reference 55 is made to point to the new element just written. Thus, new data always overwrites the oldest data in the ring and the ring is read starting from the newest data and proceeding to the second newest data toward the oldest data. Of course, it is also possible to use the linked ring in the reverse order, in which case reading proceeds counter-clockwise and writing clockwise.

In the foregoing, the invention has been described by way of example by the aid of the attached drawings, but different embodiments are possible within the scope of the inventive idea defined by the claims.

We claim:

1. Genetic procedure for allocating calls entered via landing call devices of elevators comprised in an elevator group, in which procedure a plurality of allocation options, i.e. chromosomes are formed, each of which contains a call data item and an elevator data item for each active landing call, and these data, i.e. genes together define an elevator to serve each landing call, a fitness function value is determined for each chromosome, one or more of the chromosomes are modified in respect of at least one gene and fitness function values are determined for the chromosomes thus obtained, chromosome modifications are repeated until a predetermined termination criterion is fulfilled, and based on the fitness function values, the best chromosome is selected and the calls are allocated to the elevators in the elevator group in accordance with this solution, characterised in that the chromosomes and the corresponding fitness function values are collected in a file, i.e. a gene bank, and each chromosome generated is compared with the chromosomes in the gene bank, and a fitness function value is only determined for a new chromosome not found in the gene bank, whereupon the new chromosome and the corresponding fitness function value are added into the gene bank.

2. Procedure as defined in claim 1, characterised in that the chromosomes constitute a generation, from which a new generation is formed using a genetic algorithm, via selection, crossbreeding and/or mutation.

3. Procedure as defined in claim 2, characterised in that the termination criterion is fulfilled when a predetermined fitness function value, number of generations or processing time or a sufficient homogeneity of the population is reached.

4. Procedure as defined in claim 1, characterised in that the gene bank comprises a range of addresses, each chromosome being assigned a home address defining the position of the chromosome in the gene bank.

5. Procedure as defined in claim 4, characterised in that the home address of the chromosome is determined from one or more of its genes on the basis of e.g. the content of the genes, the number of genes or the width of the gene bank.

6. Procedure as defined in claim 4, characterised in that a plurality of chromosomes are located at the same home address.

7. Procedure as defined in claim 4, characterised in that chromosomes having the same home address are linked to form a chain of unlimited length.

8. Procedure as defined in claim 4, characterised in that a chain of chromosomes having the same home address is implemented as a fixed table of definite length.

9. Procedure as defined in claim 7, characterised in that a new chromosome is stored in the first position in a chain or table starting from the home address.

10. Procedure as defined in claim 7, characterised in that a chromosome searched for and found in the chain or table is moved to the beginning of the chain or table.

11. Procedure as defined in claim 7, characterised in that a chromosome searched for and found in the chain or table is moved in the chain or table towards the beginning.

12. Procedure as defined in claim 8, characterised in that when a chromosome is to be stored in a full table, the oldest one of the chromosomes in the table is removed.

13. Procedure as defined in claim 8, characterised in that when a chromosome is to be stored in a full table, the one of the chromosomes in the table that has the lowest fitness function value is removed.

14. Procedure as defined in claim 8, characterised in that when a chromosome is to be stored in a full table, the last one of the chromosomes in the table is removed.

15. Procedure as defined in claim 4, characterised in that from each home address there is a reference to a list structure linked in two directions and arranged in a ring.

16. Procedure as defined in claim 15, characterised in that the ring-like list structure is read in the clockwise direction until the desired genes are encountered, until the data read is not valid or until the beginning of the list is reached again after a full circle.

17. Procedure as defined in claim 15, characterised in that data is written to the ring-like list structure in the counter-clockwise direction and the home address reference is made to point to the new element just written.

18. Procedure as defined in claim 1, characterised in that additional information descriptive of the chromosome is stored in the gene bank.

* * * * *